US010843035B2

(12) United States Patent
Jolly

(10) Patent No.: US 10,843,035 B2
(45) **Date of Patent: *Nov. 24, 2020**

(54) EXERCISE RING FOR IMPROVING STRENGTH AND FLEXIBILITY OF A BODY PART

(71) Applicant: Mission Competition Fitness Equipment, Redondo Beach, CA (US)

(72) Inventor: Michael Jolly, Redondo Beach, CA (US)

(73) Assignee: MISSION COMPETITION FITNESS EQUIPMENT, Redondo Beach, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 16/163,326

(22) Filed: Oct. 17, 2018

(65) Prior Publication Data

US 2019/0060704 A1 Feb. 28, 2019

Related U.S. Application Data

(63) Continuation of application No. 15/415,478, filed on Jan. 25, 2017, now Pat. No. 10,143,883, and a (Continued)

(51) Int. Cl.
*A63B 21/00* (2006.01)
*A63B 21/02* (2006.01)
(Continued)

(52) U.S. Cl.
CPC ..... *A63B 21/4043* (2015.10); *A63B 21/023* (2013.01); *A63B 21/0608* (2013.01); (Continued)

(58) Field of Classification Search
CPC ..... A63B 21/0088; A63B 21/023; A63B 21/0608; A63B 21/072; A63B 21/151; (Continued)

(56) References Cited

U.S. PATENT DOCUMENTS 2,496,748 A 2/1950 Pond
3,006,645 A 10/1961 Razier
(Continued)

FOREIGN PATENT DOCUMENTS

JP 07017261 U 3/1995
KR 1020010026303 A 4/2001
WO 9412242 6/1994

*Primary Examiner* — Joshua Lee
(74) *Attorney, Agent, or Firm* — Kirby Drake

(57) ABSTRACT

An apparatus and method may exercise muscles of a body part, especially the neck, waist, torso, legs, and glutes from any angle with variable resistance while taking up minimal floor space. The apparatus may improve the ability of athletes, including football players and wrestlers, to better prepare for contact from any angle while engaged in their sport. The apparatus may include a ring having a guide track therein. Another inner ring may also be provided in different sizes and shapes to accommodate a variety of users. A car may be connected to a source of resistance ride freely along the guide track. The source of resistance may be other gym equipment including a bungee cord, a cable cross over machine, springs, and the like. As the user freely exercises by moving the body part, the car may adapt to the user's position to facilitate a full range of motion.

20 Claims, 8 Drawing Sheets

Related U.S. Application Data continuation-in-part of application No. 13/457,371, filed on Apr. 26, 2012, now Pat. No. 9,873,015, and a continuation-in-part of application No. 13/252,004, filed on Oct. 3, 2011, now Pat. No. 9,555,283.

(51) Int. Cl.

| | |
|---|---|
| ***A63B 21/072*** | (2006.01) |
| ***A63B 23/025*** | (2006.01) |
| ***A63B 21/06*** | (2006.01) |
| *A63B 21/008* | (2006.01) |
| *A63B 23/00* | (2006.01) |
| *A63B 71/00* | (2006.01) |

(52) U.S. Cl.

CPC ..... *A63B 21/072* (2013.01); *A63B 21/4003* (2015.10); *A63B 21/4007* (2015.10); *A63B 21/4009* (2015.10); *A63B 21/4025* (2015.10); *A63B 21/4045* (2015.10); *A63B 23/025* (2013.01); *A63B 21/0088* (2013.01); *A63B 21/151* (2013.01); *A63B 2023/006* (2013.01); *A63B 2071/0063* (2013.01); *A63B 2225/09* (2013.01)

(58) Field of Classification Search

CPC ..... A63B 21/4003; A63B 21/4007; A63B 21/4009; A63B 21/4025; A63B 21/4043; A63B 21/4045; A63B 23/025; A63B 2023/006; A63B 2071/0063; A63B 2225/09

See application file for complete search history.

(56) References Cited

U.S. PATENT DOCUMENTS

| | | | | |
|---|---|---|---|---|
| 3,532,340 | A | 10/1970 | Nardiello | |
| 3,721,216 | A | 3/1973 | Lippe et al. | |
| 3,866,910 | A | 2/1975 | Herring | |
| 4,052,982 | A | 10/1977 | Ozeryansky | |
| 4,111,415 | A | 9/1978 | Reitano | |
| 4,340,215 | A | 7/1982 | Murphy | |
| 4,832,333 | A | 5/1989 | Lockett | |
| 5,080,045 | A | 1/1992 | Reese et al. | |
| 5,509,869 | A | 4/1996 | Miller | |
| 5,709,637 | A | 1/1998 | Gow et al. | |
| 5,813,955 | A | 9/1998 | Gutkowski et al. | |
| 5,984,836 | A | 11/1999 | Casali | |
| 6,106,437 | A | 8/2000 | Brooks | |
| 6,217,482 | B1 | 4/2001 | Yoo et al. | |
| 6,402,667 | B1 | 6/2002 | Dahn | |
| 6,440,047 | B1 | 8/2002 | Uang | |
| 6,592,536 | B1 | 7/2003 | Argenta | |
| 7,077,794 | B1 | 7/2006 | Bray | |
| 7,104,926 | B2 | 9/2006 | Carlson | |
| 7,232,357 | B2 | 6/2007 | Chen | |
| 7,390,286 | B1 | 6/2008 | Edgeton | |
| 7,468,019 | B2 | 12/2008 | Zylstra | |
| 7,611,450 | B2 | 11/2009 | Mancini | |
| 2002/0100109 | A1 | 8/2002 | Hoop | |
| 2002/0177507 | A1 | 11/2002 | Carbone | |
| 2004/0033869 | A1 | 2/2004 | Carlson | |
| 2006/0063652 | A1 | 3/2006 | Berman et al. | |
| 2008/0274858 | A1 | 11/2008 | Flavell et al. | |
| 2009/0062087 | A1 | 3/2009 | Poppinga | |
| 2010/0279830 | A1 | 11/2010 | Snagg | |
| 2010/0323861 | A1 | 12/2010 | Karwan | |
| 2011/0160022 | A1* | 6/2011 | Sato ..... | A61H 9/0078 482/113 |
| 2011/0237400 | A1 | 9/2011 | King et al. | |
| 2011/0294633 | A1 | 12/2011 | Esrick et al. | |
| 2014/0342882 | A1 | 11/2014 | Huang et al. | |
| 2017/0100620 | A1 | 4/2017 | Hsiao | |

* cited by examiner

FIG. 1
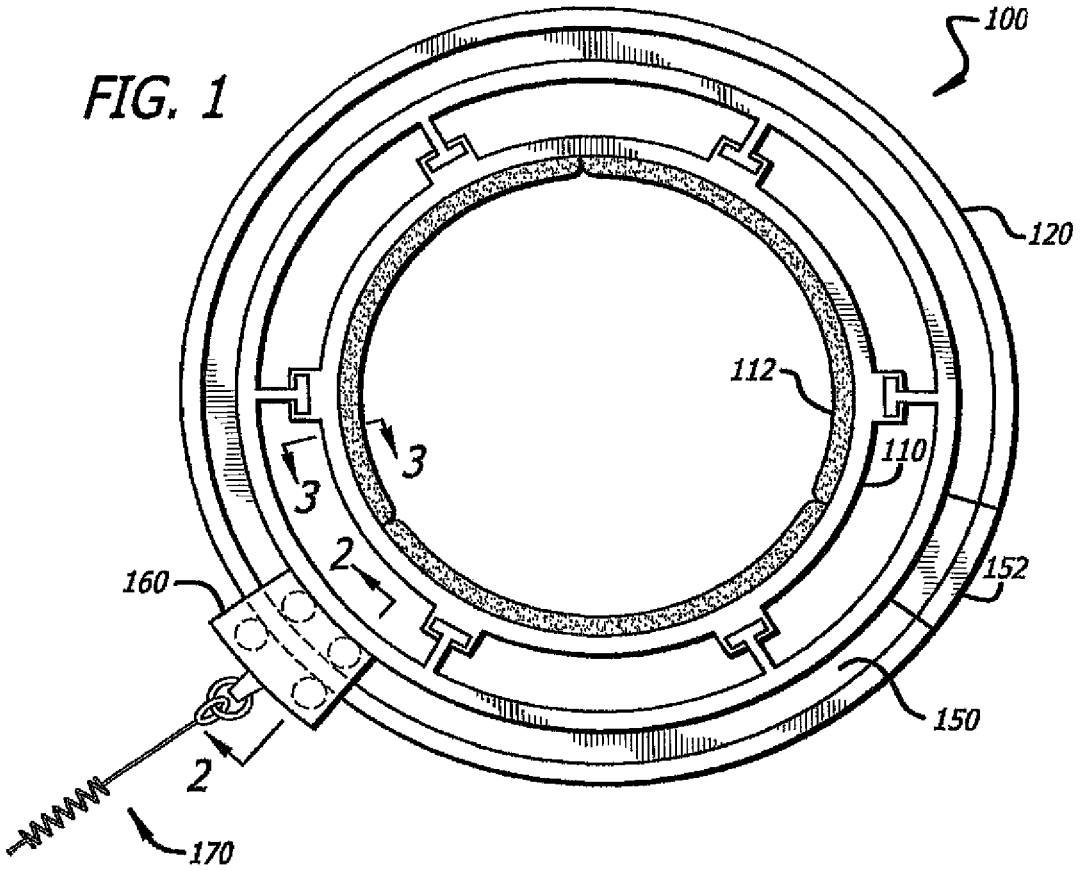
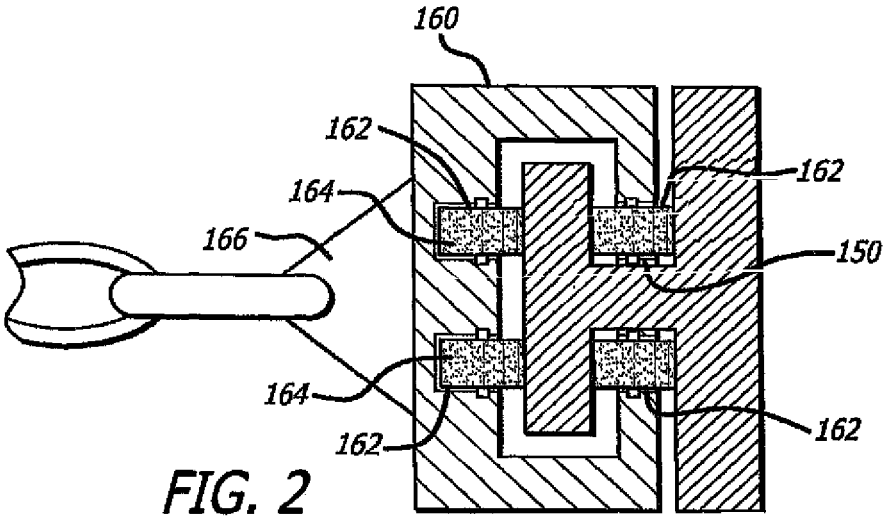
FIG. 2

FIG. 9
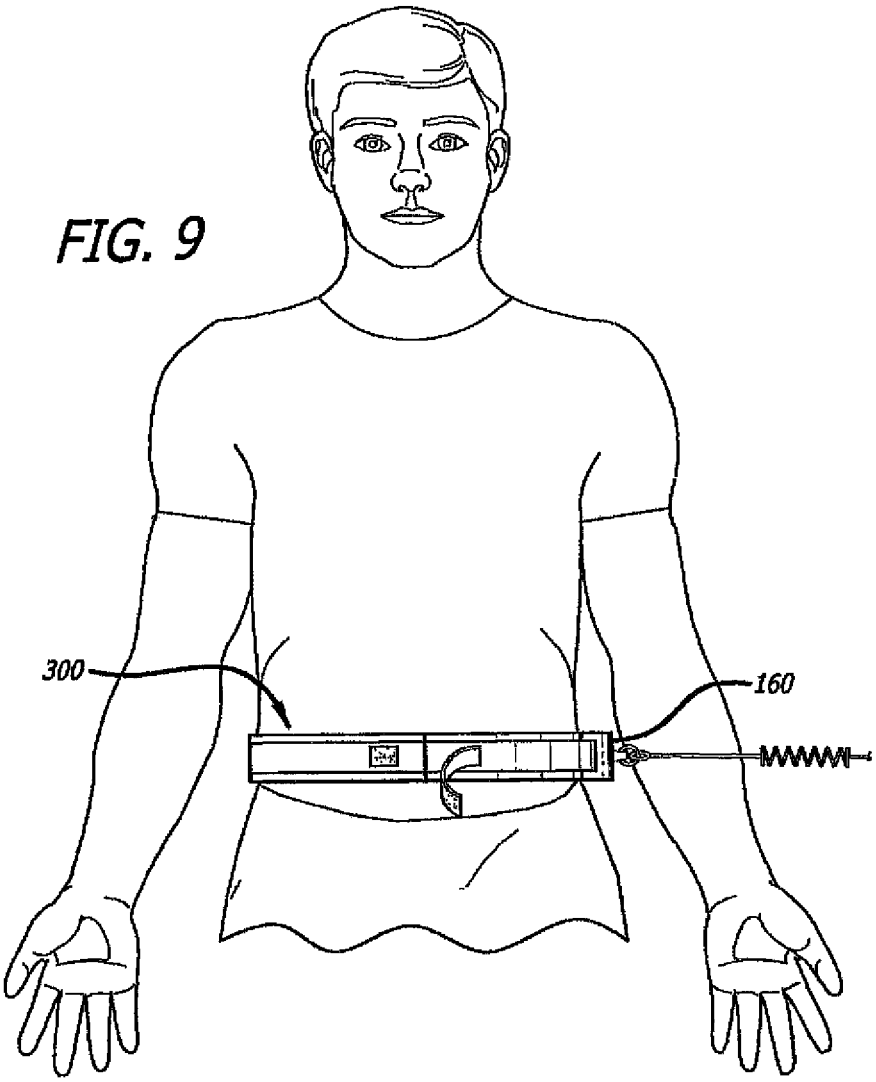
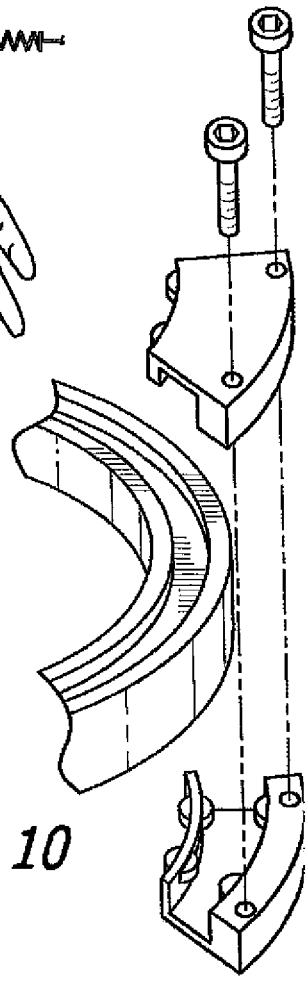
FIG. 10

EXERCISE RING FOR IMPROVING STRENGTH AND FLEXIBILITY OF A BODY PART

CROSS-REFERENCE TO RELATED APPLICATIONS

This application is a continuation of U.S. application Ser. No. 15/415,478, entitled "EXERCISE RING FOR IMPROVING STRENGTH AND FLEXIBILITY OF A BODY PART," which is a continuation-in-part of U.S. application Ser. No. 13/252,004 filed Oct. 3, 2011, entitled "EXERCISE RING FOR IMPROVING STRENGTH AND FLEXIBILITY OF A BODY PART," and a continuation-in-part of U.S. application Ser. No. 13/457,371 filed Apr. 26, 2012, entitled "EXERCISE RING FOR IMPROVING STRENGTH AND FLEXIBILITY OF A BODY PART," each of which is incorporated herein by reference in its entirety.

FIELD OF THE DISCLOSURE

The present disclosure is generally directed to apparatuses and methods for exercising the human body to improve agility, balance, coordination, flexibility, and strength. One application is particularly directed to an apparatus and a method for exercising the human neck and related muscles. Other applications are directed to an apparatus and a method for exercising the chest, the waist, the oblique side muscles, the torso, the legs, the gluteus maximus or glutes, and almost any other body part from any angle with variable resistance while taking up minimal floor space.

BACKGROUND

Traditional gym equipment for exercising, and available equipment for exercising the neck, legs, and gluteus maximus, in particular, takes up a large amount of floor space which can be very valuable in a gym environment. Gym space must be bought or leased and more space taken up by one piece of equipment limits the number of other pieces of equipment that may fit into the gym. The total amount of equipment available in turn limits the number of people that can comfortably workout at the same time and this can influence the optimal number of memberships sold. Equipment that takes up little floor space provides advantages of being able to fit more equipment into the gym so that more people can workout simultaneously and more memberships may be sold, increasing revenues for the fitness club.

Most gyms offer some form of group exercise classes which tend to be particularly popular to keep people motivated. New varieties of group exercise classes are continually emerging in an effort to keep exercise fun and interesting. Some types of group exercise classes provide some equipment with which the individual class members each work with independently while following a class instructor. For example, there are aerobic step classes in which each member has a step to work with and other strength training classes in which each member has a set of weights. For group classes incorporating some work with gym equipment, given the potentially large number of attendees or class members, it is desirable to have reasonably priced equipment for class members to use that provides a myriad of exercise possibilities so that the class instructor can be creative and provide an effective workout.

Traditional gym machines for exercising the neck, legs, gluteus maximus, and other body parts are not ideal because they only workout the body part at limited angles with a limited range of motion. In many sports, especially contact sports like football, athletes may be subjected to force from any angle. Accordingly, exercise machines that only exercise the neck, legs, gluteus maximus, or other body parts at limited angles do not adequately prepare and protect the athlete for the often unpredictable environment to which they are subjected on the playing field.

The cervical spine and muscles of the neck of the human body are extremely complex, such that the movement of the head with respect to the body requires an integrated movement of many muscles in coordination with the articulation of the cervical spine. As such, many people suffer from conditions resulting from improper orientation of the cervical spine, imbalance of the posterior cervical muscles and compression of the spine. These conditions may result from faulty or sustained postures, trauma, emotional stress and the like.

Indeed, many people exhibit a variety of discomforts caused by the misalignment of the cervical spine and imbalance of the associated muscles. For example, localized pain, headaches, decreased circulation and soreness, to name a few, decrease the quality of life of persons suffering from these conditions. These conditions have an associated cycle of pain and muscle contraction that leads to decreased function and potential soft tissue dysfunction.

The most common way to attempt to alleviate this pain is with medication. Another way to alleviate pain in this area is by strengthening and stretching the muscles in or around the head, neck, and shoulders. More specifically, the group of muscles targeted includes longissimus capitis, suboccipital, emispmalis capitis, longissimus cervicis and levator scapula. Free weights, dumbbells, and exercise/weight machines are known for building and training various muscles in the body. Despite the wide variety of exercise strengthening devices, neck muscle strengthening devices for strengthening the core muscles of the neck are not well known or widely used.

At some gyms the available floor equipment for exercising the legs and gluteus maximus is crowded and quickly filled. It is counterproductive to the goal of staying in motion to stand around waiting for desired equipment to become available.

It would be desirable to provide an apparatus for exercising the legs and gluteus maximus that an exerciser can use in an open space, empty studio, or at home, instead of waiting for gym floor equipment to become available, and that provides a greater number of possibilities for exercising the muscles from new angles to keep muscles continually challenged.

It would be desirable to provide an easy to use apparatus for strengthening and stretching the muscles of the head, neck, spine, shoulder, upper back, torso, legs, gluteus maximus, and others at any angle with variable resistance and variable size settings to accommodate a variety of users that takes up minimal space on a gym floor. It would also be desirable to provide a size-adjustable apparatus that takes up minimal floor space and can be interchangeably engaged with various sources of resistance for exercising a selected body part at any angle, including the chest, back, oblique side muscles, torso, abdominals, arms, legs, gluteus maximus, and any other body part.

SUMMARY

Embodiments of the present disclosure may provide a training tool for exercising a user's neck. The training tool may include a car that may have a first end configured to move the car using wheels or guide elements and a second end opposite the first end may have a fixed attachment port for connection to a source of resistance. A stationary guide track may be configured to provide loading and unloading of the car. The car may be configured to fit within the stationary guide track of a headpiece element and may move along the stationary guide track. A combination of the car and the stationary guide track may build neck stability and core strength. The headpiece element may have a first ring that may be configured to fit around a forehead of the user, and the first ring may be selected from a plurality of first rings that may have different shapes and sizes. The training tool may leave a top of the user's head partially uncovered. The headpiece element may include a second ring that may have a diameter that may be larger than the first ring. The second ring may be configured for positioning outside of the first ring, and the second ring may have a structure along an inner perimeter that may attached to a corresponding structure along an outer perimeter of the first ring. The stationary guide track of the headpiece element may be in the second ring, and the first ring and the second ring may be detachable. The second ring may be configured to mate and attach to the first ring. The training tool may provide at least four guide elements on the car. A first set of at least two of the at least four guide elements may fit about an inside of the stationary guide track. A second set of at least two of the at least four guide elements may fit about an outside of the stationary guide track. The structure of the second ring may attach to the corresponding structure of the first ring and may be configured to mate and attach to the first ring. The second ring may provide at least one protrusion. The corresponding structure of the first ring may comprise at least one groove that may be configured to receive and mate with the at least one protrusion on the second ring. The at least one protrusion may be telescopically extendable and retractable. The second ring may mate and attach to the first ring. The car may have a wheel for moving along the stationary guide track. The first ring may have foam padding along an inner perimeter thereof, and the foam padding may be configured to provide comfort when resting against the user's forehead. The first ring may have a protective material that may cover the foam padding. The source of resistance may be selected from the group consisting of: a bungee cord, a kettle bell, a spring under tension, a cable cross over machine, a Pilates machine, a weight stack, a weighted exercise ball, a pillar, a column, a hook on a wall, and a parachute.

Other embodiments of the present disclosure may provide a training tool for exercising a body part of a user that may provide a first ring that may be configured to be worn around the body part of the user. The first ring may have a stationary guide track therein. A car may have an attachment port that may fit and move around the stationary guide track for connection to a source of resistance. The car may be configured to fit within the stationary guide track of the first ring and to move along the stationary guide track. As the user freely moves the body part at any angle, the car may adjust its positioning along the stationary guide track while maintaining a substantially stable position of the attachment port relative to the source of resistance, thereby enhancing the user's range of motion and comfort during exercise. The training tool may provide at least four guide elements on the car, and a combination of the car and the at least four guide elements may build neck stability and core strength. The training tool may provide a harness that may be configured to be worn by the user. The harness may have a structure along an outer perimeter thereof for attaching to a corresponding structure along an inner perimeter of the first ring or along an inner perimeter of a second ring. The training tool may provide a belt that may be configured to be worn by the user. The belt may have a structure along an outer perimeter thereof for attaching to a corresponding structure along an inner perimeter of the first ring or additional rings. The first ring may be selected from a plurality of first rings having different sizes.

Further embodiments of the present disclosure may provide a training tool for exercising a body part of a user that may provide a first ring that may be configured to be worn around the body part of the user. The first ring may have a stationary guide track therein. The training tool may provide a second ring that may fit against the first ring, and the first ring may be an inner ring and the second ring may be an outer ring. The training tool may provide a car that may have an attachment port that may fit between the stationary guide track and the second ring. The car may move around the stationary guide track for connection to a source of resistance. The car may be configured to fit within the stationary guide track of the first ring and to move along the stationary guide track. As the user freely moves the body part at any angle, the car may adjust its positioning along the stationary guide track while maintaining a substantially stable position of the attachment port relative to the source of resistance, thereby enhancing the user's range of motion and comfort during exercise. At least four guide elements may be provided on the car, and a combination of the first ring, the second ring, and the car may build neck stability and core strength. At least one accessory may be configured to attach and detach from the car. A head size of the training tool may be adjustable to fit a head circumference of the user, and the training tool may be portable. The training tool may be connected to a source of resistance and may provide an adjustable fitting system that may utilize air to achieve an optimal fit.

Other features and advantages of the present disclosure will become apparent from the following detailed description, taken in conjunction with the accompanying drawings, which illustrate, by way of example, the principles of the present disclosure.

BRIEF DESCRIPTION OF THE DRAWINGS

FIG. 1 is a downward view of a headpiece element showing the inner head ring inside the outer halo ring according to an embodiment of the present disclosure.

FIG. 2 is a side view of a car received in the guide track according to an embodiment of the present disclosure.

FIG. 9 is a frontal view of an individual wearing an exercise apparatus incorporating a belt, for exercising other body parts including the legs and buttocks, around his waist with the apparatus connected to a source of resistance according to an embodiment of the present disclosure.

FIG. 10 is a perspective view of the car opening up to receive or disengage from the guide track during loading or unloading according to an embodiment of the present disclosure.

DETAILED DESCRIPTION

Provided herein is an apparatus for strengthening and stretching muscles from any angle while taking up minimal floor space at a fitness club or home gym. The apparatus is adaptable for integration with other gym equipment including cable cross over machines, weight stacks, springs, Pilates machines, weighted exercise balls, parachutes that take advantage of wind resistance, bungee cords, kettle bells, and the like through an attachment port on a car that rides freely along an outside perimeter of the apparatus.

Figure 5:
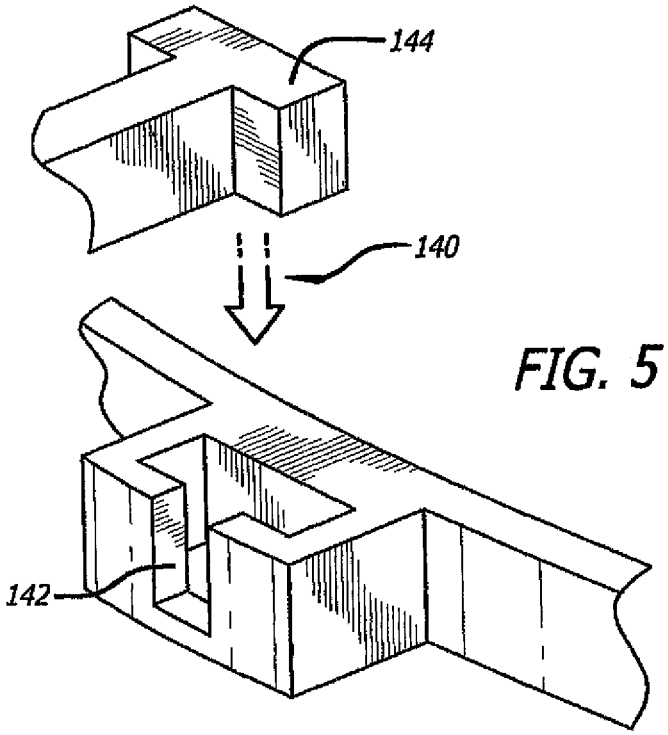
FIG. 5 is a perspective view of an inner ring engaging with the outer ring according to an embodiment of the present disclosure.
Figure 6:
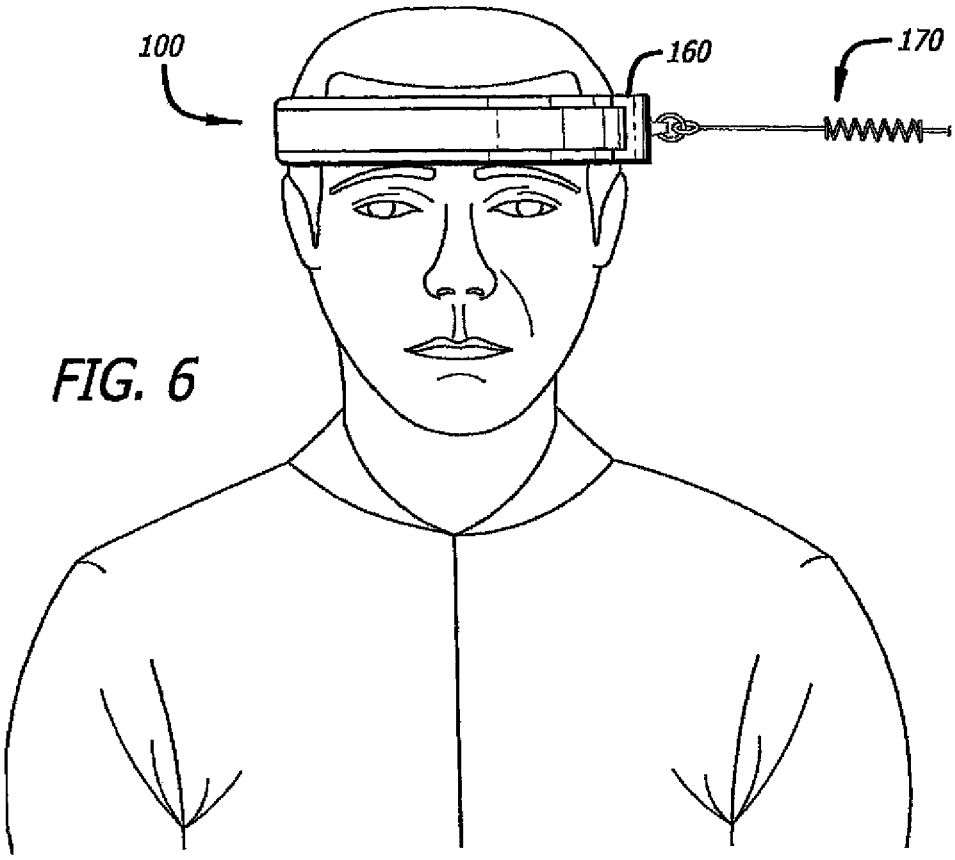
FIG. 6 is a frontal view of an individual wearing an exercise apparatus for exercising the neck on his forehead with the apparatus connected to a source of resistance according to an embodiment of the present disclosure.

According to a first aspect of the present disclosure, the apparatus is configured for strengthening and stretching the neck and related muscle groups at any angle or at several angles. In this embodiment the apparatus includes headpiece element 100 made up of inner head ring 110 and outer halo ring 120. Headpiece element 100 may be made out of any material including, but not limited to, metal, wood, and a variety of different composite materials that may be utilized in an injection mold. Inner head ring 110, 180 is provided in different shapes and sizes and can be engaged with outer halo ring 120 though a releasable locking mechanism 140. Inner head ring 110 may engage with outer halo ring 120 through a plurality of attachment ports. The attachment ports comprise structures 144 on an inner perimeter of the outer halo ring that mate with corresponding structures 142 on an outer perimeter of the inner head ring. These structures of the outer halo ring and corresponding structures of the inner head ring may include structures 114, which may be uniquely shaped protrusions and corresponding structures 142, which may be grooves, to fit the protrusions as shown in FIG. 5, or buttons that snap into position, or clips, or mating strips of materials that adhere to each other, or Velcro (trademark) strips, or the like. That is, the structure of the outer ring and the corresponding structure of the inner ring that secure the rings together may be a fastening system including two strips of nylon fabric, one having tiny hooked threads and the other a coarse surface, that form a strong bond when pressed together.

Figure 8:
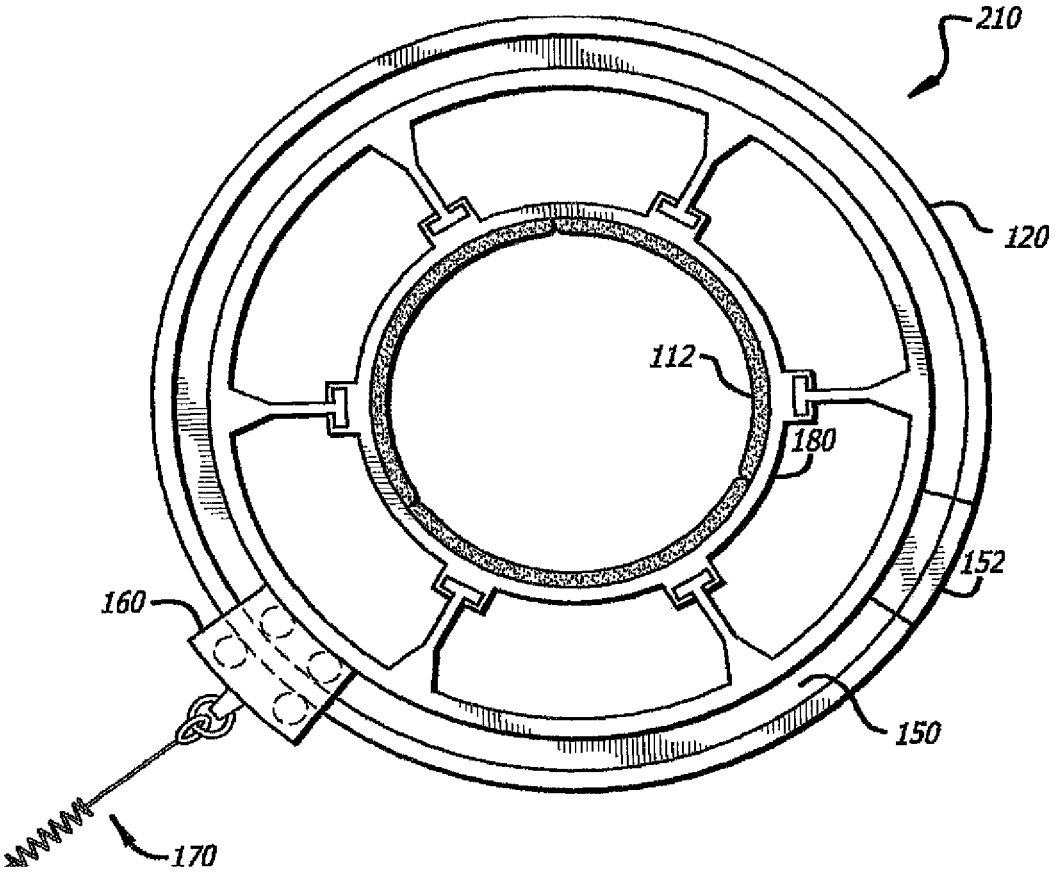
FIG. 8 is a downward view, similar to FIG. 1, showing a smaller sized inner head ring illustrating that the inner ring may come in a variety of sizes according to an embodiment of the present disclosure.
Figure 11:
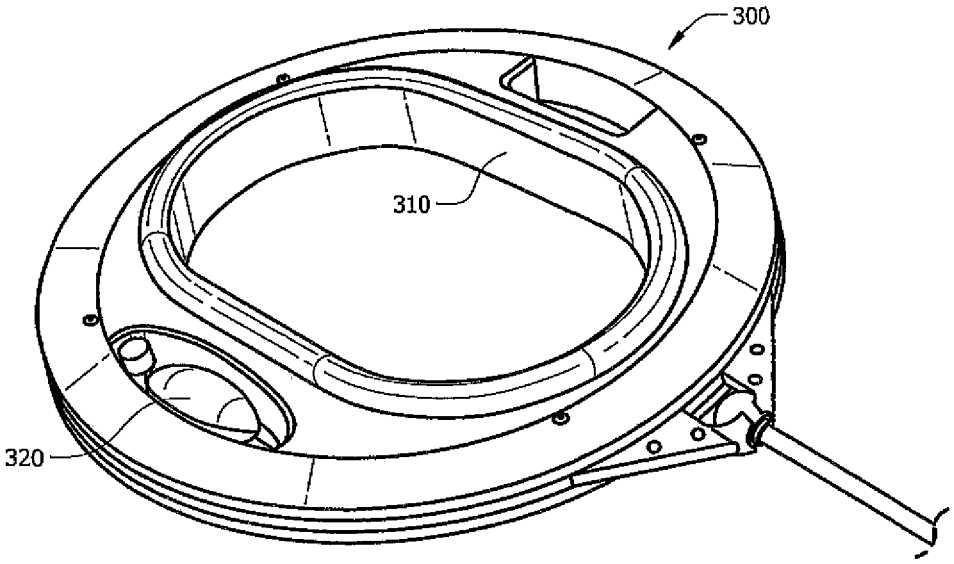
FIG. 11 is a perspective view of a waist piece element according to an embodiment of the present disclosure.
Figure 12:
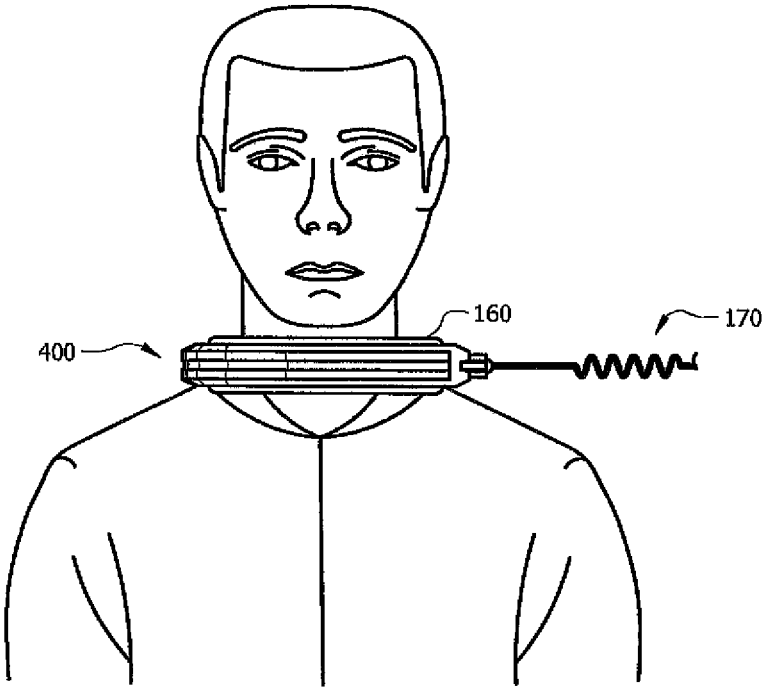
FIG. 12 is a frontal view of an individual wearing an exercise apparatus for exercising the neck on his neck with the apparatus connected to a source of resistance according to an embodiment of the present disclosure.
Figure 13:
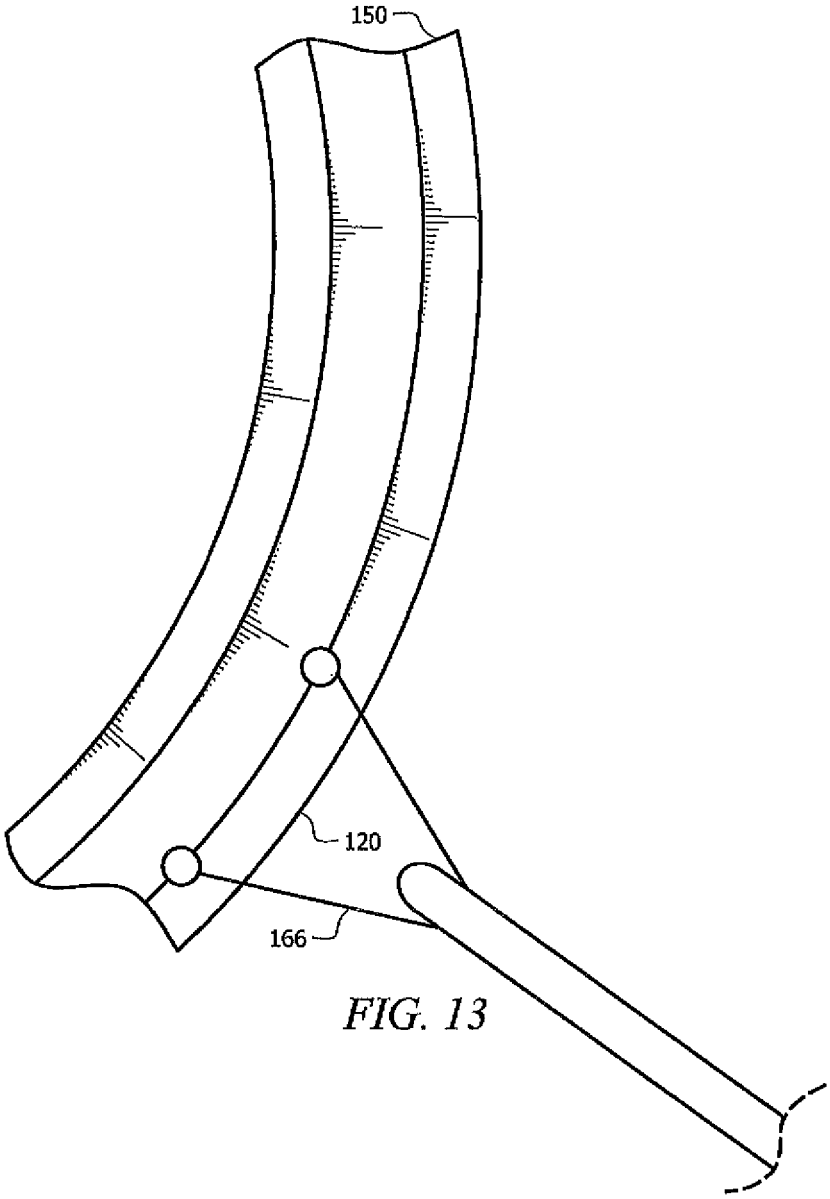
FIG. 13 is a downward view a guide track to load or unload the car according to an embodiment of the present disclosure.

The inner head ring may be provided in a variety of sizes and still fit within a uniform outer halo ring by any number of feasible structural adaptations for changing the manner in which the inner ring and outer ring fit together as the size of the inner ring varies. Comparing headpiece elements 100, 210 of FIG. 1 with FIG. 8 illustrates how inner head rings 110, 180 of different sizes may be accommodated within the same outer ring 120. Headpiece element 100 of FIG. 1 shows inner head ring 110 of a first size while headpiece element 210 of FIG. 8 shows inner head ring 180 of a second smaller size. For example, as shown in FIG. 8, the protrusions extending inward from the outer ring to meet and lock up with corresponding grooves along smaller inner ring 180 are longer than they are in FIG. 1 to meet and lock up with larger inner ring 110. The protrusions may be telescopically extendable and retractable to define a circumference of the appropriate size to fit the selected inner ring. Another option for reducing the size of the inner ring to fit a smaller head is to increase the amount of foam padding along the inner perimeter of the inner ring. Alternatively, the inner ring and outer ring may be secured to each other through mating strips having surface texture and/or made of a material such that the strips adhere to each other, for example strips available under the trademark name Velcro, among other possibilities.

According to one embodiment, outer halo ring 120 has a plurality of T-shaped protrusions 144 that fit into corresponding T-shape grooves or indentations 142 on inner head ring 110, 180. The attachment ports between the inner head ring and the outer halo ring may be equally spaced from each other around the perimeter of the rings but need not be. According to one embodiment there are six attachment ports equally spaced around the perimeter of the rings. Attachment ports may be configured to fit between guide track 150 of outer ring 120. Guide track 150 may be formed by a top portion and a bottom portion of outer ring 120 that may be attached to one another. It should be appreciated that a car attachment may fit around guide track 150 of outer ring 120 and may move along the guide track 150. Attachment port 166 may be provided on the car attachment and may connect to a source of resistance.

For user comfort, the inner head ring that fits around a user's head at the level of the forehead may include padding 112 covered with protective material 114 that is easy to clean, improves durability, and protects the padding. For example, an artificial leather or "pleather" is one example of a suitable cover material outside the foam padding. It should be appreciated that padding 112 may be made in the form of bladder 310 that may be blown up with air. It should further be appreciated that bladder 310 may be provided on any portion of padding 112. It should also be appreciated that padding 112 may be made of foam, plastic, or another material. It should be appreciated that a front piece for a forehead of a user and a back piece for a back of a head of a user may be provided. The inner head ring may be rigid or may be semi-flexible to better conform to the shape of a user's head. The inner head ring may be provided in slightly different shapes to better correspond to the actual shapes of different users' heads. For example, some people may have heads with substantially circular cross-sections while other people have heads with substantially oval or elliptical cross-sections.

Either the inner head ring or the outer halo ring or both may also include one or more straps over the head, closely corresponding to the shape of the head to provide added stability in securing the headpiece apparatus on the head of a user during exercise. According to one embodiment, the inner head ring is provided with two straps that cross each other at a ninety degree angle such that one strap runs from ear to ear of the user and the other strap runs from a front center of a user's head to a back center of a user's head when the inner head ring is correctly positioned on the head of a user. According to another embodiment, straps may be vertical adjustment straps that may include markings that may denote vertical placement of headpiece element 100 on a user's head. It should be appreciated that straps may not include markings without departing from the present disclosure. Straps may be positioned as a chin strap and/or a neck strap. It should be appreciated that any of straps may be attached to headpiece element 100 by utilizing a two-point, four-point, and/or a six-point attachment system. It should be appreciated that an attachment system may include attachment mechanisms including, but not limited to, snaps, rivets, screws, and/or looped through two slits and sewn together. It should be appreciated that a chin strap and/or a neck strap may not be included in the inner head ring without departing from the present disclosure.

Neckpiece element 400 may closely correspond to the shape of the neck of a user to provide stability in securing the neckpiece apparatus on the neck of the user during exercise. It should further be appreciated that any of straps may be attached to neckpiece element 400 by utilizing a two-point, four-point, and/or a six-point attachment system.

The outer halo ring includes a channel along an outer perimeter thereof that serves as guide track 150 for car 160 that connects the assembly of rings to source of resistance 170 through attachment port 166 on the car, as shown in FIG. 2. Source of resistance 170 may connect to the assembly of rings in car 160 and may not connect to guide track 150. According to one embodiment, the attachment port is simply a hole on an end of the car, opposite the end of the car that engages the guide track, configured to fit a hook or loop extending from a connector that attaches to a source of resistance. It should be appreciated that attachment port 166 may not be provided on the car in embodiments of the present disclosure.

Figure 3:
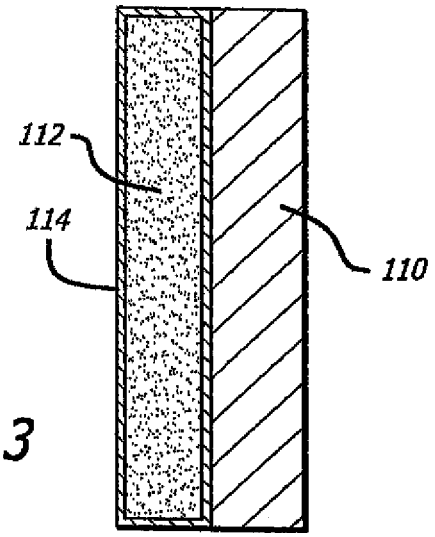
FIG. 3 is a side view of foam padding covered with a protective material along an inner surface of the head ring according to an embodiment of the present disclosure.
Figure 4:
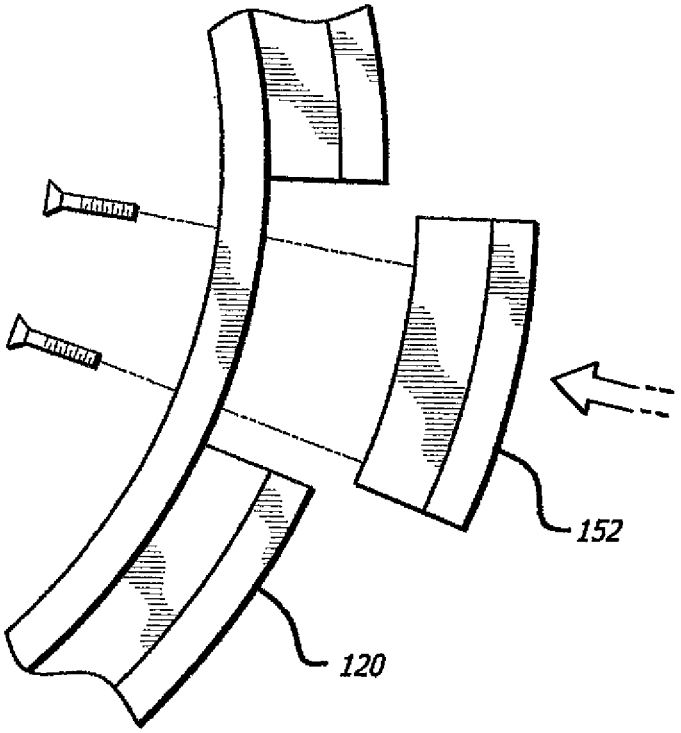
FIG. 4 is a downward view of a portion of the guide track removed to load or unload the car according to an embodiment of the present disclosure.

The car may include one or more wheels 162 or other guide elements received by guide track 150 of outer ring 120 for moving along it. The wheels or other guide elements may have lubricious surface 164 by being coated with or otherwise formed from a special low-friction material to facilitate the ability of the car to move easily along the guide track. Inner ring 110 may be fixed in place and outer ring 120 may slide on wheel 162 or wheel bearings around inner ring 110. Attachment port 166 may be fixed on the outside of outer ring 120 and may provide a connection to a source of resistance. A section 152 of the guide track may be removable for loading and unloading of the car, as shown in FIG. 4. It should be appreciated that the guide track may be stationary without departing from the present disclosure. Alternatively, as shown in FIG. 10, the car may open up or split in half, completely separating into two or more pieces or opening like a mouth about a pivot axis for loading and unloading onto a fixed or integrally formed track. According to another embodiment, guide track 150 may be stationary and may not open. It should be appreciated that guide track 150 may not include a removable section or removable sections without departing from the present disclosure.

According to a second aspect of the present disclosure, the apparatus is configured for strengthening and stretching the muscles of another body part at any angle or at several different angles. The exact structure of the embodiment will depend upon the body part desired to be exercised. A unifying principle feature across the various embodiments is a ring configured to fit around a body part having a guide track extending around the ring's outer periphery along which a car connected to a resistance source smoothly rides and adjusts as the user freely moves about.

In some embodiments of the second aspect, the assembly of an inner body part ring provided in a variety of sizes and slightly different shapes and an outer ring with the track may be provided as discussed above for the neck application. In other embodiments a single ring may be provided that fits around the body part and has a guide track built into it around its outer periphery.

Figure 7:
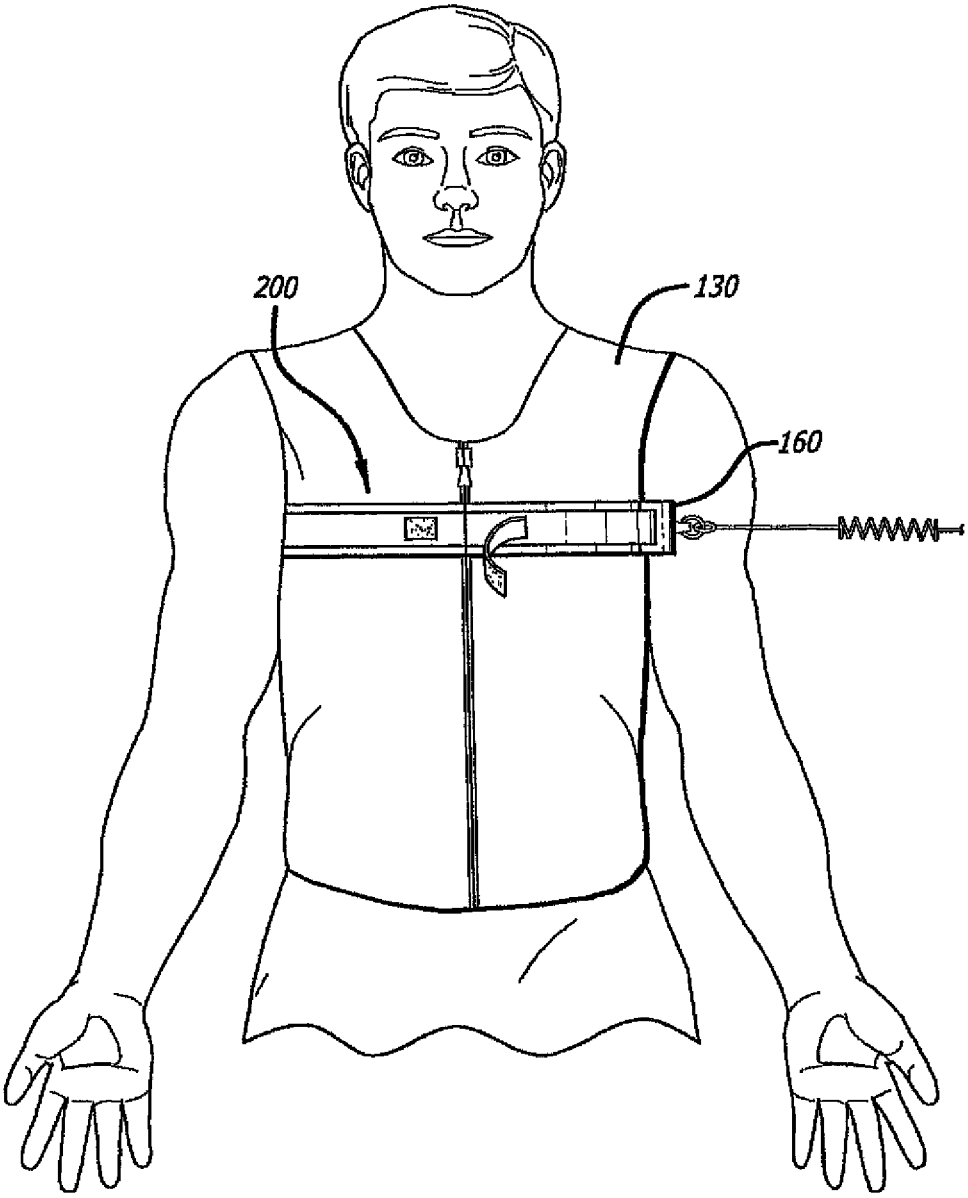
FIG. 7 is a frontal view of an individual wearing an exercise apparatus of the incorporating a harness, for exercising other body parts, around his chest with the apparatus connected to a source of resistance according to an embodiment of the present disclosure.

As shown in FIG. 7, one specific embodiment in accordance with the second aspect of the present disclosure is to provide a means to exercise the body through a chest piece element 200 including a ring or a band placed around the chest. The assembly of outer ring and inner ring may be provided or a single ring may be provided for this embodiment. According to one embodiment, a variation of the ring assembly is provided in which the inner ring is instead harness 130 or a vest that the user wears. In this embodiment, the harness or vest would have structures thereon for engaging with corresponding structures on the outer ring. According to another embodiment, the inner ring is on a harness or vest the user wears but is not itself a harness or vest. According to another embodiment, a single ring is provided having a guide track thereon for wearing around the chest. In any of these embodiments, the harness or inner ring may be made adjustable to fit different users. The harness or inner ring may incorporate Velcro (trademark) material, webbing, or similar materials and designs for adjustability.

The embodiments including a ring or assembly of rings around the chest region with or without a harness or vest will find application, for example, for football players on a field doing training drills. With this embodiment, the unpredictable experiences encountered on a field may be simulated by attaching the car riding along a guide track of the ring to a source of resistance. The resistance pulling backwards against the weight of the user simulates other players holding the user back as the user tries to run. The guide track and car assembly provided by the present disclosure enable the user to freely maneuver at any angle in attempt to break away from real or imagined obstacles. For example, the user may twist from side to side, turn, gallop, sashay, run, etc. with the source of resistance pulling back for added challenge. Using a parachute as the source of resistance would be suitable for this application. By wearing the ring having a guide track upon which a car is mounted the user is able to run and even spin or turn in circles without the connection to the source of resistance getting tangled because the car riding around along the guide track simply changes position as necessary to compensate and counter balance the user's movement to maintain a relatively stable position and angle of the car relative to the connector and to the source of resistance. That is, the car moves relative to the guide track but remains in approximately the same position relative to the source of resistance and the connector between the car and the source of resistance.

As shown in FIG. 9, another specific embodiment in accordance with the second aspect of the present disclosure is to provide a means to exercise the body, especially the various muscles of the legs and the gluteus maximus muscles of the buttocks, through waist piece element 300 including a ring or a band placed around the waist. The assembly of outer ring and inner ring may be provided or a single ring may be provided for this embodiment. According to one embodiment, a variation of the ring assembly is provided in which the inner ring is instead a waistband or belt the user wears. In this embodiment, the waistband or belt would have structures thereon for engaging with corresponding structures on the outer ring. According to another embodiment, the inner ring is on a waistband or belt the user wears but is not itself a waistband or belt. According to another embodiment, a single ring is provided having a guide track thereon for wearing around the waist. According to another embodiment, padding 112 may be made in the form of bladder 310 that may be blown up with air. It should be appreciated that bladder 310 may be provided on any portion of padding 112. It should further be appreciated that bladder 310 may be provided only along a rear portion of padding 112, only along a front portion of padding 112, only along a side(s) portion of padding 112, along any combination of a rear, front, and/or side portions of padding 112, and/or may completely encircle a body part (i.e., a user head, a user neck, a user waist, etc.) of a user when bladder 310 is in use. It should be appreciated that padding 112 that may be provided along a side(s) of a head of a user may be made of foam. Waist piece element 300 may include bladder 310 that may secure waist piece element 300 around the waist of a user by expanding with air and may capture the user's body. According to another embodiment, pump 320 may blow bladder 310 up with air. Pump 320 may be positioned proximate an outer edge or outer diameter of waist piece element 300. According to another embodiment, pump 320 may be recessed in waist piece element 300 and/or in headpiece element 100. According to another embodiment, pump 320 may be exposed in waist piece element 300 and/or in headpiece element 100. In any of these embodiments, the waistband, belt, or inner ring may be made adjustable to fit different users. The waistband, belt, or inner ring may incorporate Velcro (trademark) material, webbing, or similar materials and designs for adjustability.

The embodiments including a ring or assembly of rings around the waist region with or without a waistband or belt will find application, for example, in group exercise classes including group aerobics. With this embodiment, several individuals and a group exercise class instructor may each wear the exercise belt around the waist with the car on the ring or outer ring attached to a bungee cord and the bungee cord held to a wall or other heavy, stable structure. A resistive band may be provided that may connect to an attachment that may be provided by car 160 and may not connect to guide track 150. The bungee cord and wall or column provide the needed resistance for stretching and strengthening muscles. A breaking mechanism may be provided that may create a locational resistance that may strengthen muscles. A breaking mechanism may built into the car and may cause friction along a guide path that may slow down or prevent rotation of the car along the guide path. The class instructor can lead the class members through a series of moves that include twisting, turning, moving forward, moving backward, moving from side to side, squatting, lunging, leaping, pivoting, etc. and each exerciser will be able to move freely on account of the mobile car secured to the guide track on the ring, outer ring, exercise belt, or waistband.

The apparatus in accordance with the present disclosure may be configured for use with a source of resistance that may include any one or more of the following: a bungee cord, a kettle bell, a cable cross over machine, a Pilates machine, weight stacks, a wall, a column, a parachute, and the like.

According to another application of the apparatus in accordance with an embodiment the present disclosure, the source of resistance is a kettle bell to provide extreme conditioning. With the individual standing substantially stationary, the body part with the ring around it may be gyrated or whirled in a substantially circular motion or pivoted from side to side to move the kettle bell on the floor through the mobile car mounted on the ring.

The present disclosure is not limited to the embodiments described above. Various changes and modifications can, of course, be made, without departing from the scope and spirit of the present disclosure. Additional advantages and modifications will readily occur to those skilled in the art. Accordingly, various modifications may be made without departing from the spirit or scope of the general inventive concept as defined by the appended claims and their equivalents.

What is claimed is:

1. A training tool for exercising a user's neck, comprising:

a car having a first end configured to move the car using wheels or guide elements and a second end opposite the first end having a fixed attachment port for connection to a source of resistance; and a stationary guide track that does not open and is configured to provide loading and unloading of the car, the car configured to fit within the stationary guide track of a headpiece element and to move along the stationary guide track, wherein a combination of the car and the stationary guide track build neck stability and core strength, and wherein the car separates into two or more pieces to load and unload onto the stationary guide track.

2. The training tool of claim 1, the headpiece element further comprising:

a first ring configured to fit around a forehead of the user, the first ring selected from a plurality of first rings having different shapes and sizes.

3. The training tool of claim 2, wherein the training tool leaves a top of the user's head partially uncovered.

4. The training tool of claim 2, the headpiece element further comprising:

a second ring having a diameter larger than the first ring, the second ring configured for adjustable positioning outside of the first ring to fit a plurality of different users, the second ring having a structure along an inner perimeter for attaching to a corresponding structure along an outer perimeter of the first ring, wherein the stationary guide track of the headpiece element is in the second ring, wherein the first ring and the second ring are detachable, and wherein the second ring is configured to mate and attach to the first ring.

5. The training tool of claim 4, wherein the structure of the second ring for attaching to the corresponding structure of the first ring is configured to mate and attach to the first ring, wherein the second ring comprises at least one protrusion and the corresponding structure of the first ring comprises at least one groove configured to receive and mate with the at least one protrusion on the second ring, wherein the at least one protrusion is telescopically extendable and retractable to define a circumference of a size to fit the first ring.

6. The training tool of claim 4, wherein the second ring is mated and attached to the first ring.

7. The training tool of claim 1, further comprising:

at least four guide elements on the car, wherein a first set of at least two of the at least four guide elements fits about an inside of the stationary guide track and a second set of at least two of the at least four guide elements fits about an outside of the stationary guide track.

8. The training tool of claim 1, wherein the car has a wheel for moving along the stationary guide track.

9. The training tool of claim 2, wherein the first ring has an air bladder configured to provide comfort when resting against the user's forehead.

10. The training tool of claim 9, wherein the first ring has a protective material covering the air bladder.

11. The training tool of claim 1, wherein the source of resistance is interchangeably selected from the group consisting of: a bungee cord, a kettle bell, a spring under tension, a cable cross over machine, a Pilates machine, a weight stack, a weighted exercise ball, a pillar, a column, a hook on a wall, and a parachute.

12. A training tool for exercising a body part of a user, comprising:

a first ring adjustably configured to be worn around the body part of the user, the first ring having a stationary guide track therein that does not open; and a car that separates into two or more pieces to load and unload onto the stationary guide track, the car having an attachment port that fits and moves around the stationary guide track for connection to a source of resistance, the car configured to fit within the stationary guide track of the first ring and to move along the stationary guide track, whereby as the user freely moves the body part at any angle, the car adjusts its positioning along the stationary guide track while maintaining a substantially stable position of the attachment port relative to the source of resistance, thereby enhancing the user's range of motion and comfort during exercise; and at least four guide elements on the car, wherein a first set of at least two of the at least four guide elements fits about an inside of the stationary guide track and a second set of at least two of the at least four guide elements fits about an outside of the stationary guide track, and wherein a combination of the car and the at least four guide elements build neck stability and core strength.

13. The training tool of claim 12, further comprising:

a harness configured to be worn by the user, the harness having a structure along an outer perimeter thereof for attaching to a corresponding structure along an inner perimeter of the first ring or along an inner perimeter of a second ring.

14. The training tool of claim 12, further comprising:

a belt configured to be worn by the user, the belt having a structure along an outer perimeter thereof for attaching to a corresponding structure along an inner perimeter of the first ring or additional rings, wherein the first ring is selected from a plurality of first rings having different sizes.

15. A training tool for exercising a body part of a user, comprising:

a first ring adjustably configured to be worn around the body part of the user, the first ring having a stationary guide track therein that does not open;

a second ring that fits against the first ring, wherein the first ring is an inner ring and the second ring is an outer ring; and a car that separates into two or more pieces to load and unload onto the stationary guide track, the car having an attachment port that fits between the stationary guide track and the second ring and moves around the stationary guide track for connection to a source of resistance, the car configured to fit within the stationary guide track of the first ring and to move along the stationary guide track, whereby as the user freely moves the body part at any angle, the car adjusts its positioning along the stationary guide track while maintaining a substantially stable position of the attachment port relative to the source of resistance, thereby enhancing the user's range of motion and comfort during exercise; and at least four guide elements on the car, wherein a combination of the first ring, the second ring, and the car build neck stability and core strength.

16. The training tool of claim 15, further comprising:

at least one accessory configured to attach and detach from the car.

17. The training tool of claim 15, wherein a head size of the training tool is adjustable to fit a head circumference of the user.

18. The training tool of claim 15, wherein the training tool is portable.

19. The training tool of claim 15, wherein the training tool is connected to a source of resistance.

20. The training tool of claim 15, further comprising:

an adjustable fitting system utilizing air to achieve an optimal fit.

* * * * *